US008483603B2

(12) United States Patent
Nihonyanagi et al.

(10) Patent No.: US 8,483,603 B2
(45) Date of Patent: Jul. 9, 2013

(54) IMAGE HEATING APPARATUS AND HEATING BELT FOR USE IN THE IMAGE HEATING APPARATUS

(75) Inventors: Koji Nihonyanagi, Susono (JP); Masahito Omata, Yokohama (JP); Hideo Nanataki, Yokohama (JP); Noriaki Sato, Suntou-gun (JP); Takahiro Hosokawa, Kawasaki (JP); Takayuki Ujifusa, Ashigarakami-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 12/966,375

(22) Filed: Dec. 13, 2010

(65) Prior Publication Data

US 2011/0150545 A1 Jun. 23, 2011

(30) Foreign Application Priority Data

Dec. 18, 2009 (JP) ..... 2009-287544
Nov. 16, 2010 (JP) ..... 2010-255788

(51) Int. Cl.
*G03G 15/20* (2006.01)

(52) U.S. Cl.
USPC ..... 399/329

(58) Field of Classification Search
USPC ..... 399/329
See application file for complete search history.

(56) References Cited

U.S. PATENT DOCUMENTS 6,002,910 A * 12/1999 Eddy et al. ..... 399/329
7,155,136 B2 12/2006 Nihonyanagi et al.
7,162,194 B2 1/2007 Hotta et al.
7,190,914 B2 3/2007 Nihonyanagi et al.
7,203,438 B2 4/2007 Omata et al.
7,206,541 B2 4/2007 Fukita et al.
7,215,899 B2 5/2007 Kimizuka et al.
7,251,447 B2 7/2007 Kanamori et al.
7,518,089 B2 4/2009 Hashiguchi et al.
7,599,637 B2 10/2009 Nanataki et al.
7,630,677 B2 12/2009 Osada et al.
7,865,102 B2 1/2011 Nanataki et al.
7,873,293 B2 1/2011 Omata
2010/0232849 A1 9/2010 Nanataki et al.
2010/0316404 A1 12/2010 Fukuzawa et al.

FOREIGN PATENT DOCUMENTS

JP 58-128435 8/1983
JP 03-158878 7/1991
JP 06-202513 7/1994

(Continued)

OTHER PUBLICATIONS

Machine translation of Hama (JP 2007272223 A, listed in IDS). Publication date, Oct. 18, 2007.*
Machine translation of Gomi (JP 2008170598 A, listed in IDS). Publication date, Jul. 24, 2008.*

(Continued)

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A cylindrical heat generating belt in an image heating apparatus includes a heat generating layer, in which an electroconductive filler is dispersed in a resin material, for generating heat by being supplied with electric power; and a surface parting layer. The heat generating layer has a sheet resistance, with respect to a generatrix direction of the heat generating belt, which is larger than that with respect to a circumferential direction of the heat generating belt.

27 Claims, 5 Drawing Sheets

FOREIGN PATENT DOCUMENTS

| | | |
|---|---|---|
| JP | 2000-066539 | 3/2000 |
| JP | 2004-279547 | 10/2004 |
| JP | 2007-272223 | 10/2007 |
| JP | 2008-170598 | 7/2008 |

OTHER PUBLICATIONS

Machine translation of Gunze KK(JP,06-202513, A, listed in IDS). Publication date, Jul. 22, 1994.*

* cited by examiner

IMAGE HEATING APPARATUS AND HEATING BELT FOR USE IN THE IMAGE HEATING APPARATUS

FIELD OF THE INVENTION AND RELATED ART

The present invention relates to an image heating apparatus suitably used as a fixing device (fixing apparatus) to be mounted in an image forming apparatus such as an electrophotographic copying machine or an electrophotographic printer and relates to a heat generating belt for use in the image heating apparatus.

As the fixing device to be mounted in the electrophotographic copying machine or printer, a film heating type fixing device has been known. The film heating type fixing device includes a heater containing a ceramic substrate and an energization heat generating element disposed on the substrate, a cylindrical fixing film to be rotated while contacting the heater, and a pressing roller for forming a nip between itself and the fixing film contacted to the heater. A recording material, on which an unfixed toner image is carried, is heated while being nip-conveyed in the nip, so that the toner image on the recording material is heat-fixed on the recording material. The fixing device of this type has the advantage that the time from the start of energization of the heater to the rise in temperature up to a fixable temperature is short. Therefore, the printer in which the fixing device is mounted can reduce a first print out time (FPOT) from the input of a print instruction until a first sheet image is outputted. Further, the fixing device of this type also has the advantage that electric power (energy) consumption during stand-by for the print instruction is small.

In the film heating type fixing device, the fixing film is heated by the heater disposed inside the fixing film, so that the toner image is heat-fixed at the surface of the fixing film. For this reason, it is important to improve thermal conductivity. However, when the thermal conductivity is intended to be improved by decreasing the thickness of the fixing film, there arises a problem such that a mechanical characteristic of the fixing film is lowered and thus it is difficult to rotate the fixing film at a high speed. In order to solve this problem, in Japanese Laid-Open Patent Application (JP-A) 2000-066539, JP-A Hei 06-202513 and JP-A 2007-272223, it is proposed to use a fixing device of a type in which a fixing belt itself is provided with the heat generating element, and electric power (energy) is supplied to the heat generating element to thereby directly heat the fixing belt. The fixing device of this type further reduces the time from the start of energization of the heat generating element to the rise in temperature of the fixing belt up to the fixable temperature and further reduces the electric power consumption, and is excellent from the viewpoint of speeding up of the rotation of the fixing belt.

In the fixing device of the type in which the fixing belt is directly heated, the amount of heat generation is a maximum in an area connecting electrode members, provided at longitudinal end portions of the fixing belt along an axial line of the fixing belt, by a rectilinear line. The amount of heat generation is smaller in an area remoter from the electrode member with respect to a circumferential direction of the fixing belt. For this reason, temperature non-uniformity of the fixing belt occurs with respect to the circumferential direction of the fixing belt. In this case, the pressing roller is rotated simultaneously with the start of energization to the heat generating element of the fixing belt, so that the fixing belt is rotated by the rotation of the pressing roller. By rotating the fixing belt, it becomes possible to uniformly increase the temperature of the entire fixing belt without causing the temperature non-uniformity with respect to the circumferential direction of the fixing belt. However, when the fixing belt is rotated, the entire surface of the pressing roller is heated by heat of the fixing belt and therefore the temperature rise speed of the fixing belt becomes low. For this reason, the time from the start of energization of the heat generating element of the fixing belt to the rise in temperature of the fixing belt up to the fixable temperature is increased.

SUMMARY OF THE INVENTION

A principal object of the present invention is to provide an image heating apparatus capable of suppressing the occurrence of temperature non-uniformity with respect to a circumferential direction of a heat generating belt without affecting rotation of the heat generating belt.

Another object of the present invention is to provide the heat generating belt for use in the image heating apparatus.

According to an aspect of the present invention, there is provided a cylindrical heat generating belt for use in an image heating apparatus, comprising:

a heat generating layer, in which an electroconductive filler is dispersed in a resin material, for generating heat by being supplied with electric power; and a surface parting layer, wherein the heat generating layer has a sheet resistance, with respect to a generatrix direction of the heat generating belt, which is larger than that with respect to a circumferential direction of the heat generating belt.

According to another aspect of the present invention, there is provided an image heating apparatus comprising:

a cylindrical heat generating belt;

a back-up member for forming a nip between itself and the heat generating belt in contact with an outer surface of the heat generating belt, wherein the heat generating belt comprises:

a heat generating layer, in which an electroconductive filler is dispersed in a resin material, for generating heat by being supplied with electric power; and a surface parting layer, wherein the heat generating layer has a sheet resistance, with respect to a generatrix direction of the heat generating belt, which is larger than that with respect to a circumferential direction of the heat generating belt.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

(1) Image Forming Apparatus

Figure 3:
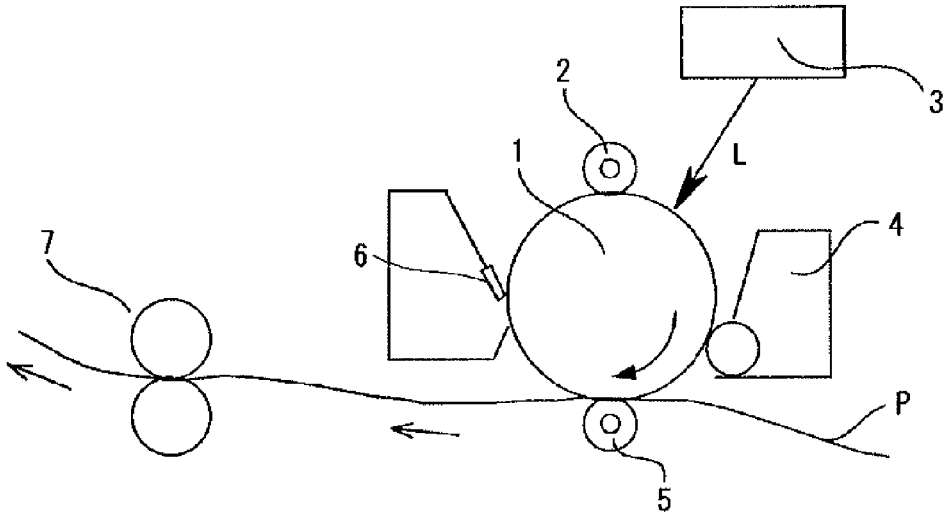
FIG. 3 is a schematic sectional view of an example of an image forming apparatus.

FIG. 3 is a schematic sectional view of an example of an image forming apparatus in which an image heating apparatus according to the present invention is mounted as a fixing device (fixing apparatus). This image forming apparatus is a laser beam printer for forming an image on a recording material such as recording paper or an OHP sheet by utilizing electrophotography. The printer in this embodiment executes a predetermined image formation control sequence by a control portion (not shown) in accordance with a print instruction outputted from an external device (not shown) such as a host computer, and effects a predetermined image forming operation in accordance with the image formation control sequence. The control portion includes a CPU and a memory such as ROM or RAM and in the memory, various programs or the like necessary for the image formation control sequence and the image formation are stored.

The printer in this embodiment includes an image forming portion for forming the toner image on the recording material and a fixing portion (fixing device) for heat-fixing an unfixed toner image on the recording material. When the image formation control sequence is executed, first, a drum-type electrophotographic photosensitive member 1 as an image bearing member (hereinafter referred to as a photosensitive drum) is rotated in a direction indicated by an arrow (FIG. 3) at a predetermined peripheral speed (process speed) at the image forming portion. Then, an outer peripheral surface (surface) of the photosensitive drum 1 is uniformly charged by a charging roller 2 as a charging member. Next, the charged surface of the photosensitive drum 1 is subjected to scanning exposure to a laser beam L which has been subjected to ON/OFF control depending on image information by an optical scanning device 3, so that an electrostatic latent image, depending on the image information, is formed on the charged surface of the photosensitive drum 1. Then, the electrostatic latent image is developed with toner (developer) into a toner image by a developing device 4.

On the other hand, a recording material P fed from a sheet feeding cassette (not shown) by a predetermined recording material feeding mechanism (not shown) is conveyed to a transfer nip between the surface of the photosensitive drum 1 and an outer peripheral surface (surface) of a transfer roller 5 as a transfer member. In the transfer nip, the recording material P is nip-conveyed by the surface of the photosensitive drum 1 and the surface of the transfer roller 5. The toner image on the surface of the photosensitive drum 1 is transferred onto the recording material P by the transfer roller 5 during a conveyance process of the recording material P. As a result, the recording material P carries the toner image.

The recording material P on which the toner image is carried is introduced into a fixing device 7, in which the recording material P is subjected to the application of heat and pressure, so that the toner image is heat-fixed on the recording material P. The recording material P on which the toner image is heat-fixed is then discharged on a discharging tray (not shown) by a predetermined recording material discharging mechanism (not shown).

The surface of the photosensitive drum 1 after the transfer of the toner image is, after residual toner remaining on the surface of the photosensitive drum 1 is removed by a cleaning blade 6 as a cleaning member, subjected to subsequent image formation.

(2) Fixing Device

In the following description, with respect to the fixing device and members or portions constituting the fixing device, a longitudinal direction refers to a direction perpendicular to a recording material conveyance direction in a plane of the recording material. This longitudinal direction is also a direction along an axis (axial line) of a fixing belt described later. A widthwise direction refers to a direction parallel to the recording material conveyance direction in the plane of the recording material. A length refers to a dimension with respect to the longitudinal direction. A width refers to a dimension with respect to the widthwise direction.

Figure 1:
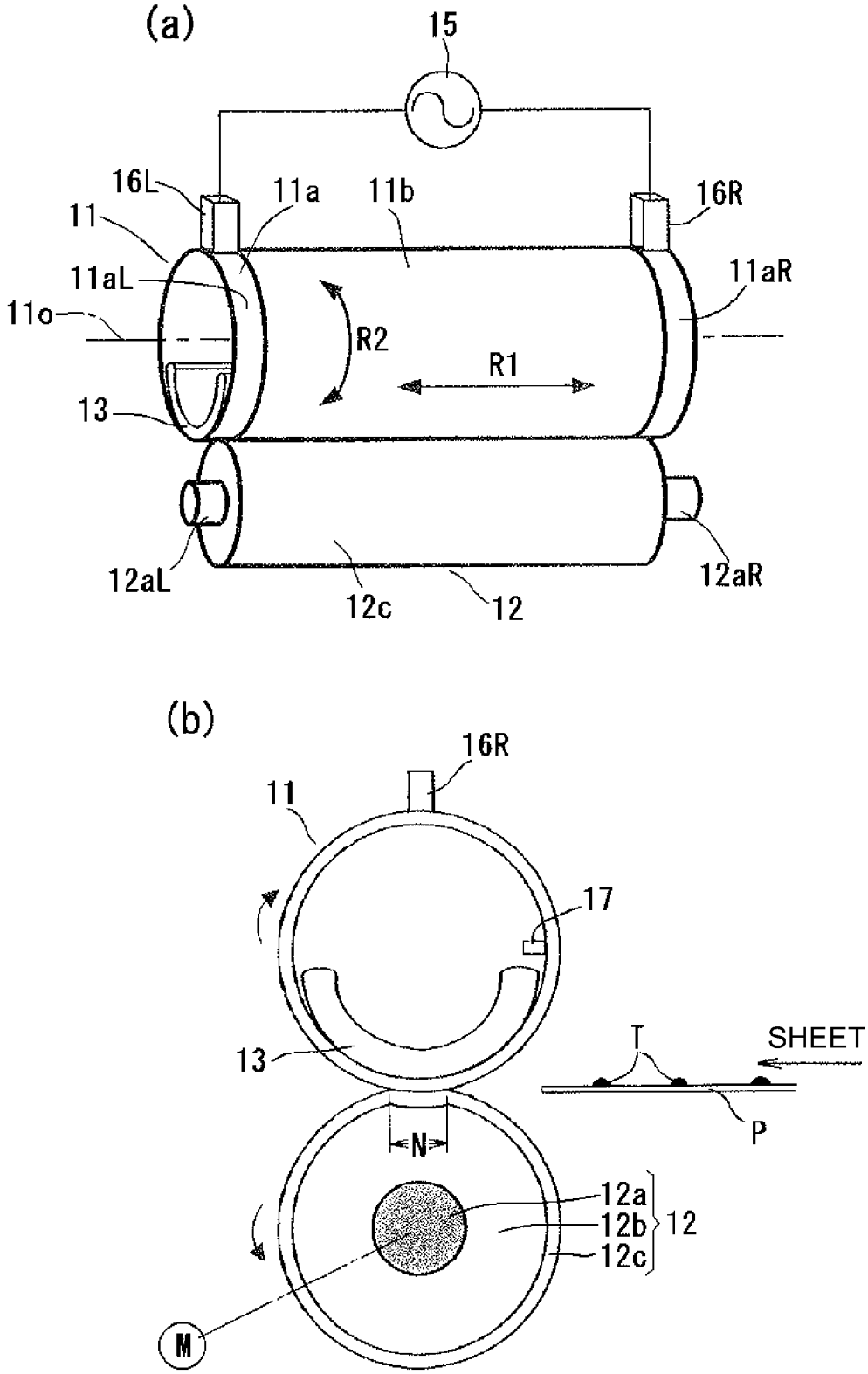
FIG. 1(*a*) is a perspective view of an outer appearance of a fixing belt of a fixing device and a pressing roller, and FIG. 1(*b*) is a schematic longitudinal sectional view of the fixing belt and the pressing roller which are shown in FIG. 1(*a*).

FIG. 1(*a*) is a perspective view for an outer appearance of the fixing belt of the fixing device and a pressing roller, and FIG. 1(*b*) is a schematic longitudinal sectional view of the fixing belt and the pressing roller shown in FIG. 1(*a*). The fixing device 7 in this embodiment includes a fixing belt 11 as a heat generating belt, a belt guide 13 as a guide member, a pressing roller 12 as a back-up member, and the like. Each of the fixing belt 11, the belt guide 13 and the pressing roller 12 is an elongated member extending in the longitudinal direction.

The fixing belt 11 is formed in a cylindrical shape. The fixing belt 11 is loosely fitted on the belt guide 13 formed in a substantially semicircular tub-like shape in cross section with an allowance of circumference with respect to the belt guide 13. The belt guide 13 may be formed of a high heat-resistant resin material such as polyimide, polyamideimide, PEEK, PPS or a liquid crystal polymer or a composite material of these resin materials with ceramics, metal, glass, or the like. In this embodiment, as the material for the belt guide, the liquid crystal polymer was used. The belt guide 13 is supported by a device frame (not shown) of the fixing device 7 at longitudinal end portions of the belt guide 13 (with respect to the longitudinal direction of the belt guide 13).

The pressing roller 12 includes a metal core 12*a*, an elastic layer (elastic member layer) 12*b* provided on the outer peripheral surface of the core metal 12*a* other than portions to be supported 12*a*R and 12*a*L at the longitudinal end portions of the core metal 12*a*, an outermost parting layer 12*c* provided on the outer peripheral surface of the elastic layer 12*b*, and the like. In this embodiment, the metal core 12*a* is formed of aluminum, the elastic layer 12*b* is formed of silicone rubber, and the parting layer 12*c* is formed of a PFA-coated material. The pressing roller 12 disposed below the fixing belt 11 in parallel to the fixing belt 11 is rotatably supported by the device frame-through bearings (not shown) at the portions to be supported 12*a*R and 12*a*L which are the longitudinal end portions of the metal core 12*a*. The pressing roller 12 is urged by an urging means (not shown), such as an urging spring, at each of the longitudinal end portions of the belt guide 12, in a direction perpendicular to a generatrix direction of the pressing roller 12. As a result, the outer peripheral surface of the fixing belt 11 is urged against the outer peripheral surface of the pressing roller 12 to place the pressing roller 12 in an urged state, so that the elastic layer 12*b* of the pressing roller 12 is elastically deformed. Thus, between the surface of the fixing belt 11 and the surface of the pressing roller 12, a fixing nip N with a predetermined width is formed.

Figure 2:
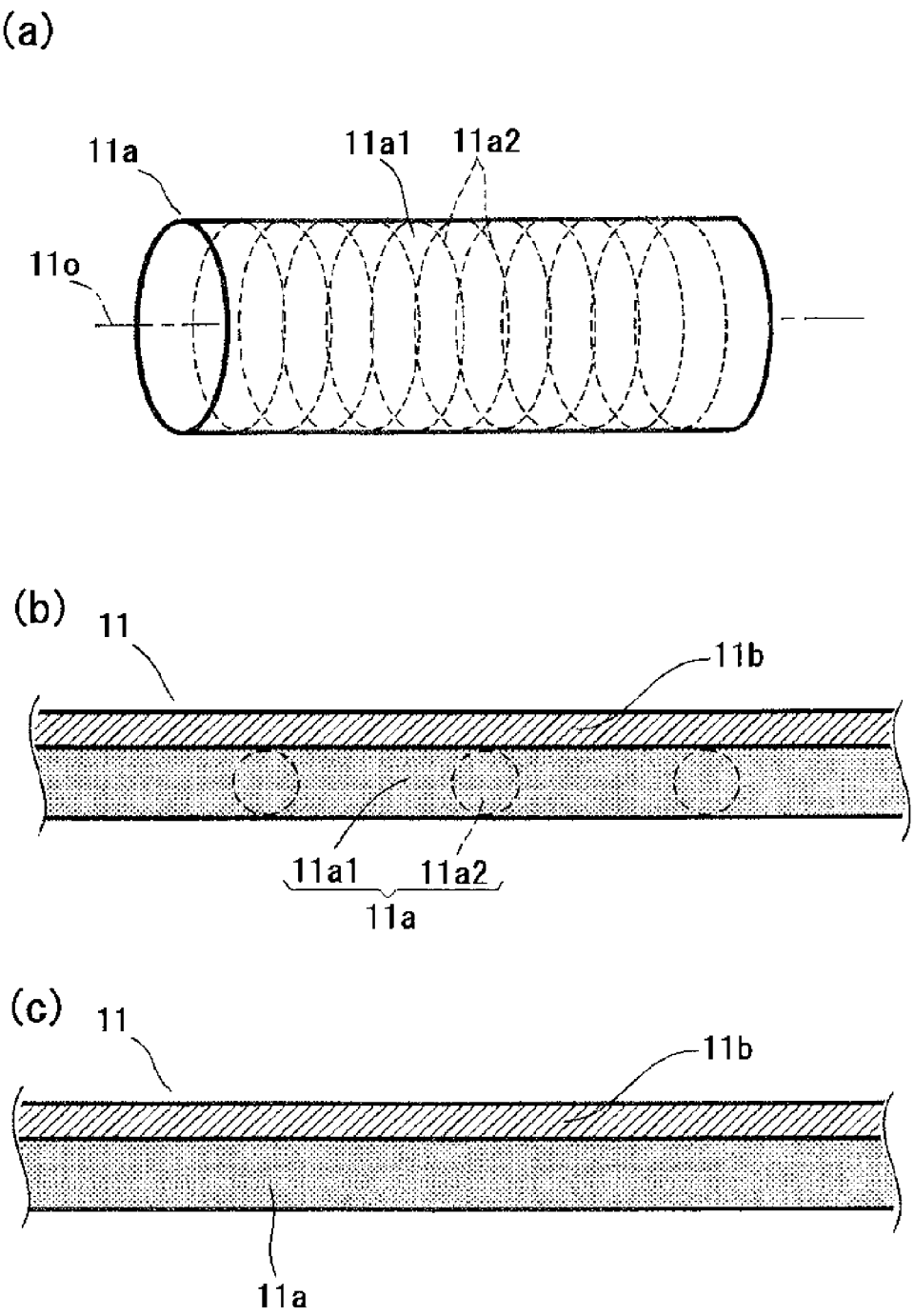
FIG. 2(*a*) is a perspective view of a heat generating layer of the fixing belt, FIG. 2(*b*) is a sectional view showing a layer structure of the heat generating layer of the fixing belt, and FIG. 2(*c*) is a sectional view showing a layer structure of Comparative embodiment fixing belt (1).

With reference to FIGS. 2(*a*) and 2(*b*), a constitution of the fixing belt 11 will be described more specifically. FIG. 2(*a*) is a perspective view showing a heat generating layer of the fixing belt 11, and FIG. 2(*b*) is a sectional view showing a layer structure of the heat generating layer of the fixing belt.

The fixing belt 11 in this embodiment includes a cylindrical heat generating layer 11*a* for generating heat by energization. The heat generating layer 11*a* contains a resin material 11*a*1 and an electroconductive filler 11*a*2 dispersed in the resin material 11*a*1. The resin material 11*a*1 is a heat-resistant resin such as polyimide, polyamideimide, PEEK, PES or PPS. The electroconductive filler 11*a*2 has a shape which provides anisotropy and is oriented in the circumferential direction of the fixing belt 11 with respect to the longitudinal direction thereof. As the electroconductive filler 11*a*2, it is possible to use, e.g., carbon nanomaterials such as carbon nanofiber, carbon nanotube and carbon microcoil, and fine particles of metals and metal oxides. The amount of the electroconductive filler 11*a*2 with respect to the resin material 11*a*1 may preferably be 30 wt. % to 60 wt. %. In this embodiment, the heat generating layer used is prepared by dispersing carbon nanotubes having a length of 150 μm in polyimide. In FIG. 2(*a*), the electroconductive filler 11*a*2 is illustrated so that portions thereof are arranged in a circular shape, and in FIG. 2(*b*), the electroconductive filler 11*a*2 is illustrated so that the portions thereof are arranged at regular intervals. However, these figures merely show an orientation direction of the electroconductive filler. As described above, the electroconductive filler 11*a*2 is dispersed in the resin material 11*a*1, so that the electroconductive filler 11*a*2 is present randomly in the heat generating layer 11 but is oriented in the circumferential direction of the fixing belt 11 with respect to a long axis thereof.

Thus, in the fixing belt 11 in this embodiment, the electroconductive filler is oriented in the circumferential direction of the belt, so that it is possible to provide an anisotropy with respect to a sheet resistance (Ω/□(ohm/square)) of the heat generating layer 11*a*. That is, when the sheet resistance of the heat generating layer 11*a* is R1 with respect to the longitudinal direction and is R2 with respect to the circumferential direction, a relationship of: R1>R2 is satisfied. In other words, the electrical sheet resistance R1 of the heat generating layer 11*a* with respect to the longitudinal direction is larger than the electrical sheet resistance R2 of the heat generating layer 11*a* with respect to the circumferential direction. The ratio between the sheet resistances R1 and R2 can be replaced by that obtained by measuring the sheet resistance of a sample sheet of the fixing belt 11 prepared in a manner that a part of the fixing belt 11 with respect to the circumferential direction is cut away in the generatrix direction to obtain a rectangular sheet and then the rectangular sheet is cut into a square sheet. For measurement, two terminals for measuring the resistance value are attached to two opposite sides of the square sheet with respect to the longitudinal direction (generatrix direction) and the sheet resistance is measured to obtain R1. Similarly, the two terminals are attached to remaining two opposite sides of the square sheet with respect to the circumferential direction and the sheet resistance is measured to obtain R2.

As a method for orienting the electroconductive filler (dispersant) in the circumferential direction of the heat generating layer 11*a*, e.g., a method in which a solution of a polyimide precursor in which the electroconductive filler is dispersed is coated on a rotating cylindrical metal mold by beam coating. Further, in the case where the image forming apparatus is operated by using a commercial power source, when the power source capacity, the print speed, the rising speed of the fixing device and the like are taken into consideration, the electric power supplied to the fixing belt 11 may preferably be 100 W to 1500 W. Therefore, the resistance value between ends of the heat generating layer 11*a* with respect to the longitudinal direction (generatrix direction), i.e., between electrodes for power supply may preferably be in a range from 5Ω to 100Ω. Further, in view of the range (5Ω to 100Ω) of the resistance value and the strength of the fixing belt 11, the heat generating layer 11*a* may preferably be 30 μm to 200 μm. On the outer peripheral surface of the heat generating layer 11*a*, a (surface) parting layer 11*b* for ensuring a parting property with respect to a toner image T (FIG. 1(*b*)) carried on the recording material P is provided. The parting layer 11*b* is formed of heat-resistant fluorine-containing resin such as PTFE, PFA, FEP or the like. The parting layer 11*b* is bonded to a primer layer (not shown) formed on the outer peripheral surface of the heat generating layer 11*a*. In the parting layer 11*b*, carbon black or ion-conductive electric resistance control substance (organic phosphorus acid, antimony pentoxide, titanium oxide, etc.) may also be dispersed.

In longitudinal end portion areas 11*a*R and 11*a*L (FIG. 1(*a*)) of the heat generating layer 11*a*, at predetermined positions of the heat generating layer 11*a* with respect to the circumferential direction, electrode members 16R and 16L for supplying the electric power to the heat generating layer 11*a* are connected. In the longitudinal end portion areas 11*a*R and 11*a*L of the heat generating layer 11*a* to which the electrode members are connected, respectively (hereinafter, these areas are referred to as power supply areas), an electroconductive agent such as Ag may be applied. When the fixing belt 11 in this embodiment is used, by applying the voltage between the electrode members 16R and 16L, the current not only linearly flows between the electrode members 16R and 16L but also extends in the circumferential direction of the fixing belt 11.

(3) Heat-Fixing Operation of Fixing Device

The heat-fixing operation of the fixing device will be described with reference to FIG. 1(*b*). The control portion rotationally drives a motor M in accordance with the print instruction. The rotation of an output shaft of the motor M is transmitted to the metal core 12*a* of the pressing roller 12 through a predetermined gear train (not shown). As a result, the pressing roller 12 is rotated in a direction indicated by an arrow at a predetermined peripheral speed (process speed). The rotation of the pressing roller 12 is transmitted to the fixing belt 11 in the fixing nip N by a frictional force between the surface of the pressing roller 12 and the surface of the fixing belt 11. As a result, the fixing belt 11 is rotated by the rotation of the pressing roller 12 while contacting the outer peripheral surface of the belt guide 13 at its inner peripheral surface. Further, the control portion starts energization from an AC power source 15 to the heat generating layer 11*a* of the fixing belt 11 through the electrode members 16R and 16L in accordance with the print instruction. As a result, the heat generating layer 11*a* generates heat, so that the fixing belt 11 is quickly increased in temperature. The temperature of the fixing belt 11 is detected by a temperature detecting member 17 such as a thermistor disposed in contact with or in proximity to the inner surface of the heat generating layer 11*a*. The temperature detecting member is supported by the device frame or the belt guide through a predetermined bracket. The control portion obtains an output signal (temperature detection signal) from the temperature detecting member 17 and controls the electric power so that the temperature of the fixing belt 11 is kept at a predetermined fixing temperature (target temperature), on the basis of the output signal. In a state in which the motor M is rotationally driven and the energization to the heat generating layer 11*a* is carried out, the recording material P on which the unfixed toner image T is carried is introduced into the fixing nip N with a toner image carrying surface upward. In the fixing nip N, the recording material P is nipped between the surfaces of the fixing belt 11 and the pressing roller 12 and is (nip-)conveyed in that state. In this conveyance process, the toner image T on the recording material P is heated and melted by the fixing belt 11 and is pressed in the fixing nip N, thus being heat-fixed on the recording material P. The recording material P on which the toner image T is heat-fixed is conveyed from the fixing nip N toward the recording material discharging mechanism.

(4) Evaluation

The fixing device in this embodiment and the fixing device in a comparative embodiment were compared with respect to the rise time. A constitution of the fixing belt of each of the fixing devices in this embodiment and in the comparative embodiment will be described below. For explanatory convenience, the fixing belt in this embodiment is referred to as the Embodiment fixing belt (1) and the fixing belt in the comparative embodiment is referred to as the Comparative embodiment fixing belt (1). Portions common to the Embodiment fixing belt (1) and the Comparative embodiment fixing belt (1) are represented by the same reference numerals or symbols. FIG. 2(*c*) is a sectional view showing a layer structure of Comparative embodiment fixing belt (1).

<Embodiment Fixing Belt (1)>

As shown in FIG. 2(*b*), the Embodiment fixing belt (1) has a two layer structure including the heat generating layer 11*a* and the parting layer 11*b*. As the heat generating layer 11*a*, a 60 μm-thick polyimide film was used. As the electroconductive filler dispersed in the heat generating layer 11*a*, carbon nanofibers (length: 150 μm) were used. The long axis of the carbon nanofibers is oriented in the circumferential direction of the belt. The amount of the electroconductive filler (carbon nanofibers) in the resin material 11*a*1 of polyimide is 40 wt. %. The heat generating layer 11*a* showed a ratio of the sheet resistance R1 with respect to the longitudinal direction to the sheet resistance R2 with respect to the circumferential direction, of R1:R2=1.6:1. As the parting layer 11*a*, a 10 μm-thick film of PFA is coated on the outer peripheral surface of the heat generating layer 11*a*. Embodiment fixing belt (1) is 24 mm in inner diameter and 230 mm in length. In each of the power supply areas 11*a*R and 11*a*L of the heat generating layer 11*a* of Embodiment fixing belt (1) at the longitudinal end portions of the heat generating layer 11*a*, the heat generating layer 11*a* is exposed without being coated with the parting layer 11*b*. The resistance value between the longitudinal ends of the heat generating layer 11*a* of Embodiment fixing belt (1) was 15Ω.

<Comparative Embodiment Fixing Belt (1)>

Comparative embodiment fixing belt (1) has a two layer structure including the heat generating layer 11*a* and the parting layer 11*b* provided on the outer peripheral surface of the heat generating layer 11*a* similarly as in Embodiment fixing belt (1). As the heat generating layer 11*a*, a 60 μm-thick polyimide film was used. As the electroconductive filler, carbon nanofibers were mixed in the heat generating layer 11*a* in an amount of 35 wt. %. At this time, the carbon nanofibers were dispersed uniformly without being not oriented in the longitudinal direction and in the circumferential direction. That is, the heat generating layer 11*a* does not provide the anisotropy with respect to the sheet resistance and is formed so as to have the substantially same sheet resistance with respect to both of the longitudinal direction and the circumferential direction. As the parting layer 11*a*, a 10 μm-thick film of PFA is coated on the outer peripheral surface of the heat generating layer 11*a*. Comparative embodiment fixing belt (1) is 24 mm in inner diameter and 230 mm in length. In each of the power supply areas 11*a*R and 11*a*L of the heat generating layer 11*a* of Comparative embodiment fixing belt (1) at the longitudinal end portions of the heat generating layer 11*a*, the heat generating layer 11*a* is exposed without being coated with the parting layer 11*b*. The resistance value between the longitudinal ends of the heat generating layer 11*a* of Comparative embodiment fixing belt (1) was 15Ω.

<Rise Time Comparison>

In the fixing devices using Embodiment fixing belt (1) and Comparative embodiment fixing belt (1), the rise time of each of Embodiment fixing belt (1) and Comparative embodiment fixing belt (1) was measured. That is, the rise time from start of energization of each of Embodiment fixing belt (1) and Comparative embodiment fixing belt (1) until the temperature rise up to the fixable temperature of the unfixed toner image was measured. In the fixing devices using Embodiment fixing belt (1) and Comparative embodiment fixing belt (1), the same pressing roller 12 was used. The pressing roller 12 was 25 mm in outer diameter. The pressing roller 12 was prepared by forming the elastic layer 12*b* of silicone rubber on the outer peripheral surface of the core metal 12*a* of Al and by coating the outer peripheral surface of the elastic layer 12*b* with the parting layer 12*c* of PFA resin. To each of the Embodiment fixing belt (1) and the Comparative embodiment fixing belt (1), a constant electric power of 600 W was supplied. With respect to each of the Embodiment fixing belt (1) and the Comparative embodiment fixing belt (1), the time from start of energization until the surface temperature of each of the Embodiment fixing belt (1) and the Comparative embodiment fixing belt (1) reaches 160° C. is shown in Table 1.

TABLE 1

| Fixing belt (1) | Time (sec) |
|---|---|
| EMB. | 2 |
| COMP. EMB. | 3.5 |

The heat generating layer 11*a* of Embodiment fixing belt (1) has the sheet resistance R1 with respect to its longitudinal direction higher than the sheet resistance R2 with respect to its circumferential direction. For this reason, in the case where the electric power is supplied from the longitudinal end portions of the heat generating layer 11*a* to the heat generating layer 11*a* through the electrode members 16R and 16L, current passing through the heat generating layer 11*a* is liable to flow in the circumferential direction of the heat generating layer 11*a*. As a result, compared with the Comparative embodiment fixing belt (1), with respect to the Embodiment fixing belt (1), heat is generated in a larger area of the heat generating layer 11*a* and therefore there is no need to rotate the Embodiment fixing belt (1) during the rising thereof. Thus, when the fixing device is actuated in the fixable state, the heat of the heat generating layer 11*a* is conducted to only a part of the pressing roller 12 with respect to the circumferential direction of the pressing roller 12, so that the temperature rise speed of the Embodiment fixing belt (1) is high. On the other hand, with respect to the Comparative embodiment fixing belt (1), the sheet resistance R1 of the heat generating layer 11*a* with respect to the longitudinal direction along an axis 110 and the sheet resistance R2 of the heat generating layer 11*a* with respect to the circumferential direction are uniform. For that reason, in the case where the electric power is supplied from the longitudinal end portions of the heat generating layer 11*a* to the heat generating layer 11*a* through the electrode members 16R and 16L, the current passing through the heat generating layer 11*a* is liable to concentrate at an area connecting the electrode members 16R and 16L by a rectilinear line. As a result, a part of the heat generating layer 11*a* with respect to the circumferential direction generates the heat, so that there is a possibility that the temperature non-uniformity of the heat generating layer 11*a* with respect to the circumferential direction occurs. Therefore, during the rising, the pressing roller 12 is rotated simultaneously with start of energization to the heat generating layer 11*a*, so that the Comparative embodiment fixing belt (1) is rotated by the rotation of the pressing roller 12. As a result, it was possible to uniformly increase the temperature of the entire heat generating layer 11*a* without causing the temperature non-uniformity of the heat generating layer 11*a* with respect to the circumferential direction by rotating the Comparative embodiment fixing belt (1), but the entire surface of the pressing roller 12 was also heated and thus the temperature rise speed was slow.

The fixing device 7 in this embodiment provides the anisotropy with respect to the sheet resistance of the heat generating layer 11*a* of the fixing belt 11. That is, the sheet resistance R1 of the heat generating layer 11*a* with respect to the longitudinal direction (energization direction) is made larger than the sheet resistance R2 of the heat generating layer 11*a* with respect to the circumferential direction. As a result, the current density in an area connecting the power supply areas 11*a*R and 11*a*L (the longitudinal end portions) of the heat generating layer 11*a* by a rectilinear line becomes small, so that the temperature non-uniformity of the fixing belt 11 with respect to the circumferential direction is suppressed. Therefore, there is no need to rotate the pressing roller 12 during the rising, so that the time required for increasing the temperature of the fixing belt 11 up to the fixing temperature can be reduced. Further, the temperature non-uniformity of the fixing belt 11 with respect to the circumferential direction is suppressed, so that the electrode members 16R and 16L can be disposed at any position with respect to the circumferential direction of the fixing belt 11, thus increasing the latitude in arranging the components of the apparatus.

Embodiment 2

Figure 4:
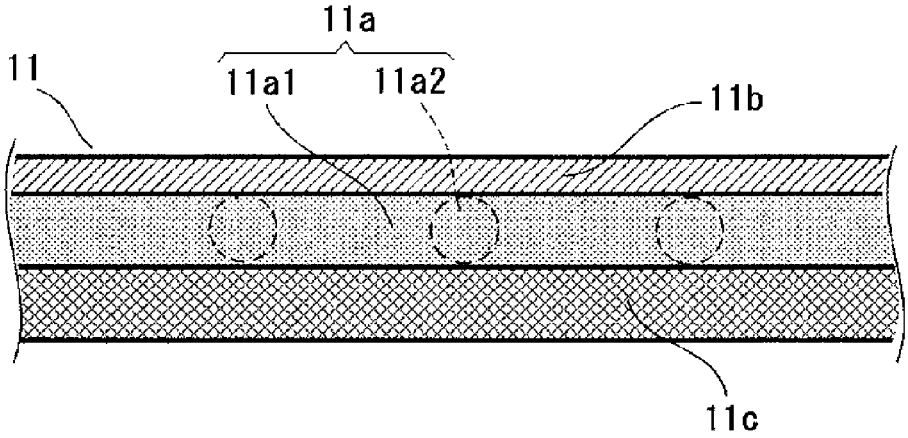
FIG. 4 is a sectional view showing a layer structure of a fixing belt used in a fixing device in Embodiment 2.

In this embodiment, a fixing device capable of performing heat fixation of the toner image T at a higher speed than that of the fixing device in Embodiment 1 will be described. With respect to the fixing device in this embodiment, members or portions identical to those of the fixing device in Embodiment 1 are represented by the same reference numerals or symbols and will be omitted from redundant description. FIG. 4 is a sectional view showing a layer structure of a fixing belt of a fixing device in this embodiment.

In order to heat-fix the toner image T at high speed, there is a need to efficiently heat the fixing belt 11 which is a heat generation source. That is, it is important that the heat generated in the heat generating layer 11*a* is more efficiently conducted to the surface of the fixing belt 11. For that purpose, the amount of heat conduction to the belt guide 13 inside the fixing belt 11 is required to be minimized. In the fixing device 7 in this embodiment, in order to insulate the inner surface of the fixing belt 11, an insulating layer 11*c* (FIG. 4) is provided on the inner peripheral surface of the heat generating layer 11*a* of the fixing belt 11, so that the outer peripheral surface of the insulating layer 11*c* and the outer peripheral surface of the belt guide 13 are contacted to each other. Therefore, the fixing belt 11 has a three layer structure consisting of the insulating layer 11*c*, the heat generating layer 11*a* provided on the outer peripheral surface of the insulating layer 11*c*, and the parting layer 11*b* provided on the outer peripheral surface of the heat generating layer 11*a*.

The fixing device 7 in this embodiment uses the fixing belt 11 including the insulating layer 11*c* on the inner peripheral surface of the heat generating layer 11*a*, so that the heat conduction from the heat generating layer 11*a* of the fixing belt 11 to the belt guide 13 is suppressed. For this reason, the time required for increasing the temperature of the fixing belt 11 up to the fixing temperature can be further reduced. Therefore, the toner image T can be heat-fixed at a higher speed than that of the fixing device 7 in Embodiment 1.

Embodiment 3

Figure 5:
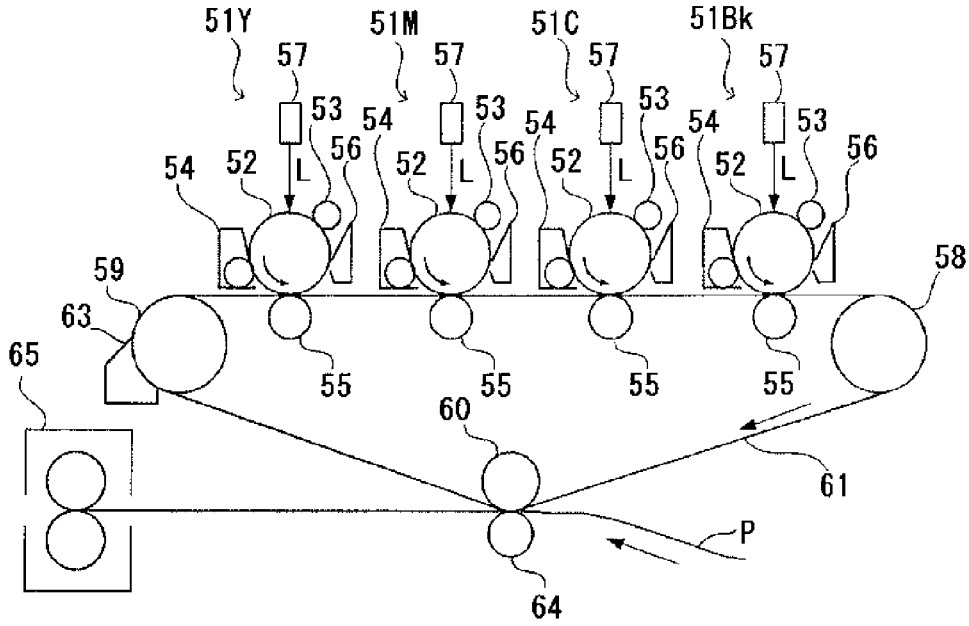
FIG. 5 is a schematic sectional view of a full-color image forming apparatus in which a fixing device in Embodiment 3 is mounted.

In this embodiment, a fixing device mounted in a full-color image forming apparatus will be described. With respect to the fixing device in this embodiment, members or portions identical to those of the fixing device in Embodiment 1 are represented by the same reference numerals or symbols and will be omitted from redundant description. FIG. 5 is a schematic structural view of the full-color image forming apparatus in which the fixing device in this embodiment is mounted.

The full-color image forming apparatus in this embodiment is a full-color laser beam printer for forming an image on a recording material such as recording paper or an OHP sheet by utilizing electrophotography. The full-color printer in this embodiment executes a predetermined image formation control sequence by a control portion (not shown) in accordance with a print instruction outputted from an external device (not shown) such as a host computer and effects a predetermined image forming operation in accordance with the image formation control sequence. The control portion includes a CPU and a memory such as ROM or RAM and in the memory, various programs or the like necessary for the image formation control sequence and the image formation are stored.

The full-color printer in this embodiment includes four image forming portions 51Y, 51M, 51C and 51Bk for forming toner images of four colors of Y (yellow), M (magenta), C (cyan) and K (black), respectively. The full-color printer also includes an intermediary transfer belt 61 as an intermediary image carrying member for carrying the toner images formed at the image forming portions.

The full-color printer further includes a fixing portion (fixing device) for heat-fixing unfixed toner images (not shown), which have been transferred from the intermediary transfer belt 61 onto the recording material P, on the recording material P. When the image formation control sequence is executed, first, the photosensitive drum 52 as the image bearing member is rotated in a direction indicated by an arrow (FIG. 5) at a predetermined peripheral speed (process speed) at each of the image forming portions 51Y, 51M, 51C and 51Bk which are successively driven. The intermediary transfer belt 61 is extended around a driving roller 58, a follower roller 59 and a secondary transfer opposite roller 60 so as to oppose the photosensitive drums 52 of the respective image forming portions 51Y, 51M, 51C and 51Bk. The intermediary transfer belt 61 is rotated in the arrow direction by the rotational driving of the driving roller 58 at a peripheral speed corresponding to the rotational peripheral speed of the respective photosensitive drums 52.

First, at the image forming portion 51Y for a first color of yellow, an outer peripheral surface (surface) of the photosensitive drum 52 is uniformly charged by a charging roller 2 as a charging member. Next, the charged surface of the photosensitive drum 52 is subjected to scanning exposure by being exposed to a laser beam L which has been subjected to ON/OFF control, depending on image information by an optical scanning device 57, so that an electrostatic latent image, depending on the image information, is formed on the charged surface of the photosensitive drum 52. Then, the electrostatic latent image is developed with toner (developer) into a toner image by a developing device 54.

Similar steps of the charging, the exposure and the development are also performed at the image forming portion 51M for a second color of magenta, the image forming portion 51C for a third color of cyan, and the image forming portion 51Bk for a fourth color of black.

At each of the image forming portions 51Y, 51M, 51C and 51Bk, a primary transfer roller 51 as a primary transfer member is disposed opposed to the associated photosensitive drum 52 through the intermediary transfer belt 61. Further, the color toner images formed on the surfaces of the photosensitive drums 52 at the respective image forming portions 51Y, 51M<51C and 51Bk are successively transferred superposedly onto the outer peripheral surface of the intermediary transfer belt 61 by the primary transfer rollers 55. As a result, a full-color toner image is carried on the surface of the intermediary transfer belt 61.

The surface of the photosensitive drum 52 after the transfer of the toner image is, after residual toner remaining on the surface of the photosensitive drum 52 is removed by a cleaning blade 56 as a cleaning member, subjected to subsequent image formation.

On the other hand, the recording material P fed from the sheet feeding cassette (not shown) by the predetermined recording material conveying mechanism (not shown) is conveyed to a transfer nip between the surface of the intermediary transfer belt 61 and the outer peripheral surface of a secondary transfer roller 64 as a secondary transfer member. The recording material P is nip-conveyed in the transfer nip by the surface of the intermediary transfer belt 61 and the surface of the secondary transfer roller 64. Then, the full-color toner image on the surface of the intermediary transfer belt 61 is transferred onto the recording material P by the secondary transfer roller 64 in a conveying process of the recording material P. As a result, the recording material P carries the full-color toner image. From the surface of the intermediary transfer belt 61 after the transfer of the full-color toner image, the residual toner remaining on the surface of the intermediary transfer belt 61 is removed by a cleaning blade 63 as the cleaning member, so that the surface of the intermediary transfer belt 61 is subjected to subsequent image formation.

The recording material P on which the full-color toner image is carried is introduced into a fixing device 65, in which the full-color toner image is subjected to the application of heat and pressure and is heat-fixed on the recording material P. The recording material P on which the full-color toner image is heat-fixed is discharged on the discharging tray (not shown) by the predetermined recording material discharging mechanism (not shown).

(2) Fixing Device

Figure 6:
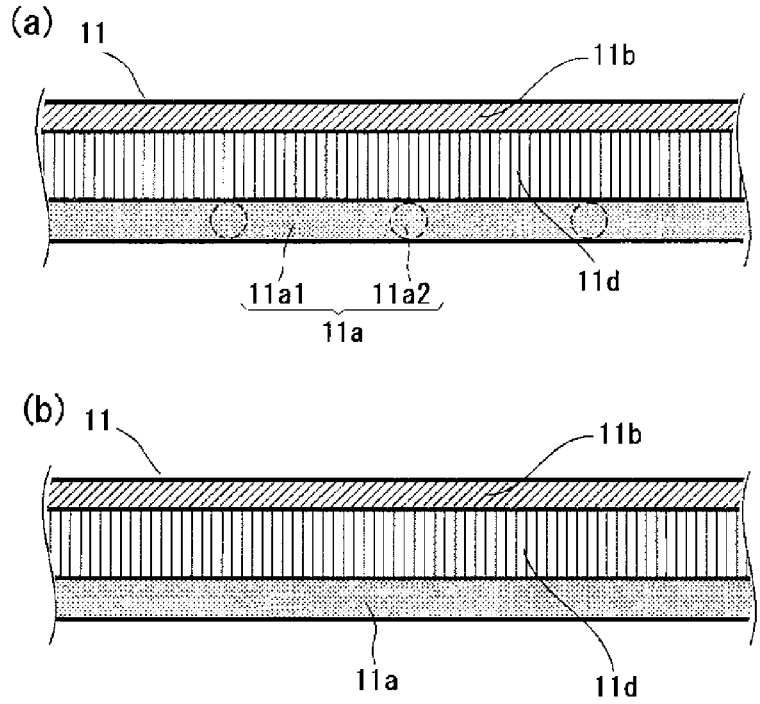
FIG. 6(*a*) is a sectional view showing a layer structure of a fixing belt used in the fixing device in Embodiment 3, and FIG. 6(*b*) is a sectional view showing a layer structure of Comparative embodiment fixing belt (3).

The constitution of the fixing device 65 in this embodiment is identical to that of the fixing device 7 in Embodiment 1 except that the fixing belt 11 has a three layer structure. FIG. 6(*a*) is a sectional view showing the layer structure of the fixing belt 11 used in the fixing device 65 in this embodiment. In the fixing device 65 in this embodiment, the fixing belt 11 may preferably be provided with an elastic layer from the viewpoint of image qualities in terms of gloss non-uniformity, OHT transparency, halftone image uniformity since the full-color toner image is heat-fixed on the recording material P. That is, an elastic layer 11*d* is provided on the outer peripheral surface of the heat generating layer 11*a* of the fixing belt 11 and on the outer peripheral surface of the elastic layer 11*d*, the parting layer 11*b* is provided (FIG. 6(*a*)). The elastic layer 11*d* is formed of silicone rubber. The elastic layer 11*d* may preferably have a thickness of 50 μm to 500 μm.

(3) Evaluation

The fixing device 65 in this embodiment and the fixing device in a comparative embodiment were compared with respect to the rise time. A constitution of the fixing belt of each of the fixing devices in this embodiment and in the comparative embodiment will be described. For explanatory convenience, the fixing belt 11 in this embodiment is referred to as Embodiment fixing belt (3) and the fixing belt in the comparative embodiment is referred to as Comparative embodiment fixing belt (3). Portions common to Embodiment fixing belt (1) and Comparative embodiment fixing belt (3) are represented by the same reference numerals or symbols. FIG. 6(*b*) is a sectional view showing a layer structure of Comparative embodiment fixing belt (3).

<Embodiment Fixing Belt (3)>

As shown in FIG. 6(*a*), Embodiment fixing belt (3) has the three layer structure including the heat generating layer 11*a*, the elastic layer 11*d* provided on the outer peripheral surface of the heat generating layer 11*a* and the parting layer 11*b* provided on the outer peripheral surface of the elastic layer 11*d*. As the heat generating layer 11*a*, a 60 μm-thick polyimide film was used. As the electroconductive filler dispersed in the heat generating layer 11*a*, carbon nanofibers (length: 150 μm) were used. The amount of the electroconductive filler (carbon nanofibers) in the resin polyimide is 40 wt. %. The heat generating layer 11*a* showed a ratio of the sheet resistance R1 with respect to the longitudinal direction to the sheet resistance R2 with respect to the circumferential direction, of R1:R2=1.6:1. The elastic layer 11*d* is formed of silicone rubber with a thickness of 300 μm. As the parting layer 11*a*, a 10 μm-thick film of PFA is coated on the outer peripheral surface of the elastic layer 11*d*. Embodiment fixing belt (3) is 24 mm in inner diameter and 230 mm in length. In each of the power supply areas 11*a*R and 11*a*L of the heat generating layer 11*a* of Embodiment fixing belt (3) at the longitudinal end portions of the heat generating layer 11*a*, the heat generating layer 11*a* is exposed without being coated with the elastic layer 11*d* and the parting layer 11*b*. The resistance value between the longitudinal ends of the heat generating layer 11*a* of Embodiment fixing belt (3) was 15Ω.

<Comparative Embodiment Fixing Belt (3)>

Comparative embodiment fixing belt (3) has the three layer structure including the heat generating layer 11*a*, the elastic layer 11*d* provided on the outer peripheral surface of the heat generating layer 11*a*, and the parting layer lib provided on the outer peripheral surface of the elastic layer 11*d* similarly as in Embodiment fixing belt (3). As the heat generating layer 11*a*, a 60 μm-thick polyimide film was used. As the electroconductive filler dispersed in the heat generating layer 11*a*, carbon nanofibers (length: 150 μm) were mixed in the heat generating layer 11*a* in an amount of 35 wt. %. At this time, the carbon nanofibers were dispersed uniformly without being not oriented in the longitudinal direction and in the circumferential direction. That is, the heat generating layer 11*a* does not provide the anisotropy with respect to the sheet resistance and is formed so as to have the substantially same sheet resistance with respect to both of the longitudinal direction and the circumferential direction. The elastic layer 11*d* is formed of silicone rubber with a thickness of 300 μm. As the parting layer 11*a*, a 10 μm-thick film of PFA is coated on the outer peripheral surface of the elastic layer 11*d*. Comparative embodiment fixing belt (3) is 24 mm in inner diameter and 230 mm in length. In each of the power supply areas 11*a*R and 11*a*L of the heat generating layer 11*a* of the Comparative embodiment fixing belt (3) at the longitudinal end portions of the heat generating layer 11*a*, the heat generating layer 11*a* is exposed without being coated with the elastic layer 11*d* and the parting layer 11*b*. The resistance value between the longitudinal ends of the heat generating layer 11*a* of the Comparative embodiment fixing belt (3) was 15Ω.

<Rise Time Comparison>

In the fixing devices using Embodiment fixing belt (3) and the Comparative embodiment fixing belt (3), the rise time of each of the Embodiment fixing belt (3) and the Comparative embodiment fixing belt (3) was measured. That is, the rise time from the start of energization to each of the Embodiment fixing belt (3) and the Comparative embodiment fixing belt (3) until the temperature rise up to the fixable temperature of the unfixed toner image was measured. In the fixing devices using the Embodiment fixing belt (3) and the Comparative embodiment fixing belt (3), the same pressing roller 12 was used. The pressing roller 12 was 25 mm in outer diameter. The pressing roller 12 was prepared by forming the elastic layer 12*b* of silicone rubber on the outer peripheral surface of the core metal 12*a* of Al and by coating the outer peripheral surface of the elastic layer 12*b* with the parting layer 12*c* of PFA resin. To each of the Embodiment fixing belt (3) and the Comparative embodiment fixing belt (3), constant electric power of 600 W was supplied. With respect to each of the Embodiment fixing belt (3) and the Comparative embodiment fixing belt (3), the time from start of energization until the surface temperature of each of the Embodiment fixing belt (3) and the Comparative embodiment fixing belt (3) reaches 160° C. is shown in Table 2.

TABLE 2

| Fixing belt (3) | Time (sec) |
|---|---|
| EMB. | 4 |
| COMP. EMB. | 7.5 |

The heat generating layer 11*a* of the Embodiment fixing belt (3) has the sheet resistance R1 with respect to its longitudinal direction higher than the sheet resistance R2 with respect to its circumferential direction. For this reason, in the case where the electric power is supplied from the longitudinal end portions of the heat generating layer 11*a* to the heat generating layer 11*a* through the electrode members 16R and 16L, current passing through the heat generating layer 11*a* is liable to flow in the circumferential direction of the heat generating layer 11*a*. As a result, compared with the Comparative embodiment fixing belt (3), with respect to the Embodiment fixing belt (3), heat is generated in a larger area of the heat generating layer 11*a* and therefore there is no need to rotate Embodiment fixing belt (3) during the rising thereof. Thus, when the fixing device is actuated in the fixable state, the heat of the heat generating layer 11*a* is conducted to only a part of the pressing roller 12 with respect to the circumferential direction of the pressing roller 12, so that a temperature rise speed of the Embodiment fixing belt (3) is high. On the other hand, with respect to the Comparative embodiment fixing belt (3), the sheet resistance R1 of the heat generating layer 11*a* with respect to the longitudinal direction along an axis 110 and the sheet resistance R2 of the heat generating layer 11*a* with respect to the circumferential direction are uniform. For that reason, in the case where the electric power is supplied from the longitudinal end portions of the heat generating layer 11*a* to the heat generating layer 11*a* through the electrode members 16R and 16L, the current passing through the heat generating layer 11*a* is liable to concentrate at an area connecting the electrode members 16R and 16L by a rectilinear line. As a result, a part of the heat generating layer 11*a* with respect to the circumferential direction generates the heat, so that there is a possibility that the temperature non-uniformity of the heat generating layer 11*a* with respect to the circumferential direction occurs. Therefore, during the rising, the pressing roller 12 is rotated simultaneously with start of energization to the heat generating layer 11*a*, so that the Comparative embodiment fixing belt (3) is rotated by the rotation of the pressing roller 12. As a result, it was possible to uniformly increase the temperature of the entire heat generating layer 11*a* without causing the temperature non-uniformity of the heat generating layer 11*a* with respect to the circumferential direction by rotating the Comparative embodiment fixing belt (3), but the entire surface of the pressing roller 12 was also heated and thus the temperature rise speed was slow.

The fixing device 65 in this embodiment includes the elastic layer 11*d*, provided on the outer peripheral surface of the heat generating layer 11*a* of the fixing belt 11 in order to heat-fix the full-color toner image on the recording material. As a result, when the full-color toner image is heat-fixed, a good image from the viewpoints of image qualities in terms of gloss non-uniformity, OHT transparency, halftone uniformity is obtained. Further, even in the case of using the fixing belt 11, there is no need to rotate the pressing roller 12 during the rising, so that the time required for increasing the temperature of the fixing belt 11 up to the fixing temperature can be reduced.

Embodiment 4

Figure 7:
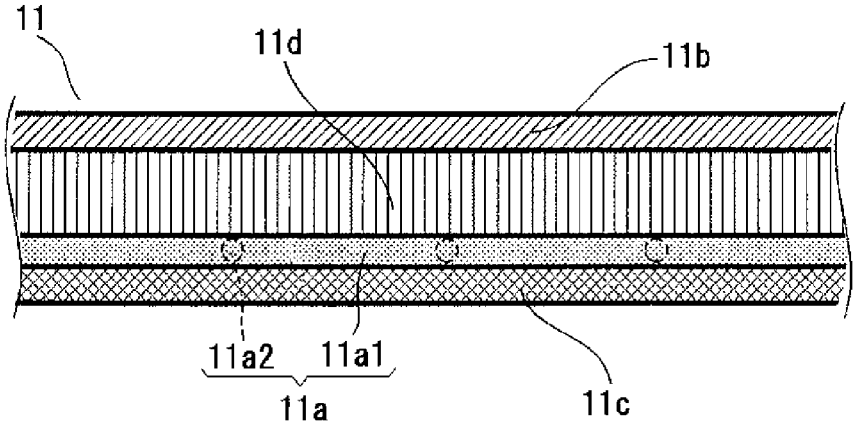
FIG. 7 is a sectional view showing a layer structure of a fixing belt used in a fixing device in Embodiment 4.

In this embodiment, a fixing device capable of performing heat fixation of the full-color toner image T at a higher speed than that of the fixing device in Embodiment 3 will be described. With respect to the fixing device in this embodiment, members or portions identical to those of the fixing device 65 in Embodiment 3 are represented by the same reference numerals or symbols and will be omitted from redundant description. FIG. 7 is a sectional view showing a layer structure of a fixing belt of a fixing device in this embodiment.

In order to heat-fix the full-color toner image at high speed, there is a need to efficiently heat the fixing belt 11, which is a heat generation source. That is, it is important that the heat generated in the heat generating layer 11*a* is more efficiently conducted to the surface of the fixing belt 11. For that purpose, the amount of heat conduction to the belt guide 13 inside the fixing belt 11 is required to be minimized. In the fixing device 65 in this embodiment, in order to insulate the inner surface of the fixing belt 11, an insulating layer 11*c* (FIG. 7) is provided on the inner peripheral surface of the heat generating layer 11*a* of the fixing belt 11, so that the outer peripheral surface of the insulating layer 11*c* and the outer peripheral surface of the belt guide 13 are contacted to each other. Therefore, the fixing belt 11 has a four layer structure consisting of the insulating layer 11*c*, the heat generating layer 11*a* provided on the outer peripheral surface of the insulating layer 11*c*, the elastic layer 11*d* provided on the outer peripheral surface of the heat generating layer 11*a*, and the parting layer lib provided on the outer peripheral surface of the elastic layer 11*d*.

The fixing device 65 in this embodiment uses the fixing belt 11 including the insulating layer 11*c* on the inner peripheral surface of the heat generating layer 11*a*, so that the heat conduction from the heat generating layer 11*a* of the fixing belt 11 to the belt guide 13 is suppressed. For this reason, there is no need to rotate the pressing roller 12 during the rising, so that the time required for increasing the temperature of the fixing belt 11 up to the fixing temperature can be further reduced. Therefore, the full-color toner image can be heat-fixed at a higher speed than that of the fixing device 65 in Embodiment 3. Further, the elastic layer 11*d* is provided on the outer peripheral surface of the heat generating layer 11*a*, so that a good image from the viewpoints of image qualities in terms of gloss non-uniformity, OHT transparency, halftone image uniformity when the full-color toner image is heat-fixed.

Other Embodiments

The fixing devices in Embodiments 1 to 4 are not limited to the image heating apparatus for heat-fixing the unfixed toner image on the recording material. For example, the fixing devices can also be used as an apparatus for temporarily fixing the unfixed toner image on the recording material by heating the unfixed toner image and an apparatus for imparting gloss to the toner image surface by heating the toner image heat-fixed on the recording material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 287544/2009 filed Dec. 18, 2009 and 255788/2010 filed Nov. 16, 2010, which are hereby incorporated by reference.

What is claimed is:

1. A cylindrical heat generating belt for use in an image heating apparatus, comprising:

a heat generating layer, in which an electroconductive filler is dispersed in a resin material, for generating heat by being supplied with electric power;

wherein in an area of the heat generating layer except for end portion areas to which electrode members are connected, the heat generating layer has a sheet resistance, with respect to a generatrix direction of the heat generating belt, which is larger than that with respect to a circumferential direction of the heat generating belt.

2. A belt according to claim 1, wherein the electroconductive filler has an anisotropic shape and is oriented in the circumferential direction of the belt in the resin material.

3. A belt according to claim 2, wherein the heat generating layer has a resistance value of 5Ω to 100Ω between the electrode members with respect to the generatrix direction of the belt.

4. A belt according to claim 2, wherein the electroconductive filler is contained in the heat generating layer in an amount of 30 wt. % to 60 wt. %.

5. A belt according to claim 1, further comprising an elastic layer and a surface parting layer.

6. An image heating apparatus comprising:

a cylindrical heat generating belt, the heat generating belt comprises a heat generating layer, in which an electroconductive filler is dispersed in a resin material, for generating heat by being supplied with electric power;

a back-up member for forming a nip between itself and the heat generating belt in contact with an outer surface of the heat generating belt; and electrode members for supplying the electric power to the heat generating layer, wherein in an area of the heat generating layer except for end portion areas to which the electrode members are connected, the heat generating layer has a sheet resistance, with respect to a generatrix direction of the heat generating belt, which is larger than that with respect to a circumferential direction of the heat generating belt.

7. An apparatus according to claim 6, wherein the electroconductive filler has an shape anisotropy and is oriented in the circumferential direction of the belt in the resin material.

8. An apparatus according to claim 7, wherein the heat generating layer has a resistance value of 5Ω to 100Ω between the electrode members with respect to the generatrix direction of the belt.

9. An apparatus according to claim 7, wherein the electroconductive filler is contained in the heat generating layer in an amount of 30 wt. % to 60 wt. %.

10. An apparatus according to claim 6, wherein the heat generating belt comprises an elastic layer and a surface parting layer.

11. A cylindrical heat generating belt for use in an image heating apparatus, comprising:

a heat generating layer made of polyimide, polyamide-imide, polyether-ether-ketone, polyether-sulfone, or polyphenylene-sulfide, in which an electroconductive filler is dispersed, for generating heat by being supplied with electric power, wherein in an area of the heat generating layer except for end portion areas to which electrode members are connected, the electroconductive filler has an anisotropic shape and is oriented in the circumferential direction of the belt.

12. A belt according to claim 11, wherein the heat generating layer has a resistance value of 5Ω to 100Ω between the electrode members with respect to the generatrix direction of the belt.

13. A belt according to claim 11, wherein the electroconductive filler is contained in the heat generating layer in an amount of 30 wt. % to 60 wt. %.

14. A belt according to claim 11, further comprising an elastic layer and a surface parting layer.

15. An image heating apparatus comprising:

a cylindrical heat generating belt, the heat generating belt comprising a heat generating layer made of polyimide, polyamide-imide, polyether-ether-ketone, polyether-sulfone, or polyphenylene-sulfide, in which an electroconductive filler is dispersed, for generating heat by being supplied with electric power;

a back-up member for forming a nip between itself and the heat generating belt in contact with an outer surface of the heat generating belt; and electrode members for supplying the electric power to the heat generating layer, wherein in an area of the heat generating layer except for end portion areas to which the electrode members are connected, the electroconductive filler has an anisotropic shape and is oriented in the circumferential direction of the belt.

16. An apparatus according to claim 15, wherein the heat generating layer has a resistance value of 5Ω to 100Ω between the electrode members with respect to the generatrix direction of the heat generating belt.

17. An apparatus according to claim 15, wherein the electroconductive filler is contained in the heat generating layer in an amount of 30 wt. % to 60 wt. %.

18. A cylindrical heat generating belt for use in an image heating apparatus, comprising:

a heat generating layer for generating heat by being supplied with electric power, wherein in an area of the heat generating layer except for end portion areas to which electrode members are connected, the heat generating layer has a sheet resistance, with respect to a generatrix direction of the heat generating belt, which is larger than that with respect to a circumferential direction of the heat generating belt.

19. A belt according to claim 18, wherein an electroconductive filler, which has an anisotropic shape and is oriented in the circumferential direction of the belt, is dispersed in a resin material of the heat generating layer.

20. An image heating apparatus comprising:

a cylindrical heat generating belt comprising a heat generating layer for generating heat by being supplied with electric power;

a back-up member for forming a nip between itself and the heat generating belt in contact with an outer surface of the heat generating belt; and electrode members for supplying the electric power to the heat generating layer, wherein in an area of the heat generating layer except for end portion areas to which the electrode members are connected, the heat generating layer has a sheet resistance, with respect to a generatrix direction of the heat generating belt, which is larger than that with respect to a circumferential direction of the heat generating belt.

21. An apparatus according to claim 20, wherein an electroconductive filler, which has an anisotropic shape and is oriented in the circumferential direction of the belt, is dispersed in the heat generating layer.

22. A cylindrical heat generating belt for use in an image heating apparatus, comprising:

a heat generating layer for generating heat by being supplied with electric power, wherein in a sheet-passing-area of the heat generating layer, the heat generating layer has a sheet resistance, with respect to a generatrix direction of the heat generating belt, which is larger than that with respect to a circumferential direction of the heat generating belt.

23. A belt according to claim 22, wherein an electroconductive filler, which has an anisotropic shape and is oriented in the circumferential direction of the belt, is dispersed in the heat generating layer.

24. An image heating apparatus comprising:

a cylindrical heat generating belt comprising a heat generating layer for generating heat by being supplied with electric power;

a back-up member for forming a nip between itself and the heat generating belt in contact with an outer surface of the heat generating belt; and electrode members for supplying the electric power to the heat generating layer, wherein in a sheet-passing-area of the heat generating layer, the heat generating layer has a sheet resistance, with respect to a generatrix direction of the heat generating belt, which is larger than that with respect to a circumferential direction of the heat generating belt.

25. An apparatus according to claim 24, wherein an electroconductive filler, which has an anisotropic shape and is oriented in the circumferential direction of the belt, is dispersed in the heat generating layer.

26. A cylindrical heat generating belt for use in an image heating apparatus, comprising:

a heat generating layer made of polyimide, polyamide-imide, polyether-ether-ketone, polyether-sulfone, or polyphenylene-sulfide, in which an electroconductive filler is dispersed, for generating heat by being supplied with electric power, wherein the electroconductive filler has an anisotropic shape and is oriented in the circumferential direction of the belt in a sheet-passing-area of the heat generating layer.

27. An image heating apparatus comprising:

a cylindrical heat generating belt, the heat generating belt comprises a heat generating layer made of polyimide, polyamide-imide, polyether-ether-ketone, polyether-sulfone, or polyphenylene-sulfide, in which an electroconductive filler is dispersed, for generating heat by being supplied with electric power;

a back-up member for forming a nip between itself and the heat generating belt in contact with an outer surface of the heat generating belt; and electrode members for supplying the electric power to the heat generating layer, wherein the electroconductive filler has an anisotropic shape and is oriented in the circumferential direction of the belt in a sheet-passing-area of the heat generating layer.

* * * * *